US010006427B2

(12) United States Patent
Wang

(10) Patent No.: US 10,006,427 B2
(45) Date of Patent: Jun. 26, 2018

(54) CENTRIFUGAL CONICAL-SPRAY NOZZLE

(71) Applicant: Kangmei Wang, Heze (CN)

(72) Inventor: Kangmei Wang, Heze (CN)

( * ) Notice: Subject to any disclaimer, the term of this patent is extended or adjusted under 35 U.S.C. 154(b) by 103 days.

(21) Appl. No.: 14/910,666

(22) PCT Filed: Aug. 19, 2013

(86) PCT No.: PCT/CN2013/000964
§ 371 (c)(1),
(2) Date: Feb. 5, 2016

(87) PCT Pub. No.: WO2015/024139
PCT Pub. Date: Feb. 26, 2015

(65) Prior Publication Data

US 2016/0177905 A1 Jun. 23, 2016

(51) Int. Cl.
*F02M 61/16* (2006.01)
*F23R 3/38* (2006.01)
(Continued)

(52) U.S. Cl.
CPC ..... *F02M 61/162* (2013.01); *F02M 61/06* (2013.01); *F02M 61/10* (2013.01);
(Continued)

(58) Field of Classification Search
CPC ..... F23R 3/38; F23D 11/04; F02M 61/06; F02M 61/1806; F02M 61/1893; F02M 61/10; F02M 61/162; F02M 61/163
See application file for complete search history.

(56) References Cited

U.S. PATENT DOCUMENTS 3,531,052 A * 9/1970 Berlyn ..... F02M 61/08 239/533.12
4,192,466 A * 3/1980 Tanasawa ..... F02M 51/0671 239/464
(Continued)

FOREIGN PATENT DOCUMENTS

DE 102006022672 A1 * 11/2007 ..... F02M 51/005
JP 10122098 A * 5/1998 ..... F02M 61/163
(Continued)

*Primary Examiner* — Steven J Ganey
*Assistant Examiner* — Steven M Cernoch
(74) *Attorney, Agent, or Firm* — Han IP Corporation; Andy M. Han

(57) ABSTRACT

A centrifugal conical-spray atomization device. A head portion of a needle valve is provided with a throttling guidance cone. A seat surface of the needle valve mates with seat surface of a spin chamber to open and close a spray hole in a pulsatory manner. A plurality of tangential holes are provided between a pressure chamber and a spin chamber. After being spun tangentially by the spin chamber, fuel is sprayed from a spray opening with a tangential force, forming a hollow umbrella-like fuel film without a compact fuel spray core. The umbrella-like fuel film has a controllable penetration distance and spins at a high speed in a combustion chamber. The centrifugal conical-spray atomization device not only exhibits a wide adjustable range of fuel flow, but is able to automatically open and close the spray hole, while carbon deposition would not easily form to block the spray hole.

6 Claims, 7 Drawing Sheets

(51) Int. Cl.

| | |
|---|---|
| ***F23D 11/04*** | (2006.01) |
| ***F02M 61/06*** | (2006.01) |
| ***F02M 61/10*** | (2006.01) |
| ***F02M 61/18*** | (2006.01) |

(52) U.S. Cl.
CPC .... *F02M 61/1806* (2013.01); *F02M 61/1893* (2013.01); *F23D 11/04* (2013.01); *F23R 3/38* (2013.01)

(56) References Cited

U.S. PATENT DOCUMENTS 4,365,746 A * 12/1982 Tanasawa ..... F02M 61/162 239/125
4,771,984 A * 9/1988 Szablewski ..... F02M 51/0675 239/533.11
4,865,003 A * 9/1989 Scharnweber ..... F02M 27/04 123/538
6,042,028 A * 3/2000 Xu ..... B05B 1/3073 239/461
6,748,872 B2 * 6/2004 Parrish ..... F02B 61/045 123/305
6,764,027 B2 * 7/2004 Dantes ..... F02M 61/162 239/489
7,712,684 B2 * 5/2010 Masuda ..... F02M 61/08 239/453
8,006,500 B1 * 8/2011 Wilson, III ..... F23D 11/04 239/214.15
2010/0155510 A1 * 6/2010 Bamber ..... F01N 3/36 239/601

FOREIGN PATENT DOCUMENTS

JP 10176630 A * 6/1998 ..... F02M 61/163
JP 11107888 A * 4/1999 ..... F02M 61/163
WO WO 0233248 A2 * 4/2002 ..... F02M 61/042

* cited by examiner

CENTRIFUGAL CONICAL-SPRAY NOZZLE

CROSS-REFERENCE TO RELATED APPLICATION

This application is the U.S. national stage application of International Application No. PCT/CN2013/000964, filed on Aug. 19, 2013. The above-identified patent application is hereby incorporated by reference in its entirety.

TECHNICAL FIELD

The present disclosure relates to a new fuel atomization method and an automatic opening and closing control structure for fuel spray, in particular to a centrifugal conical-spray nozzle for engines such as reciprocating internal combustion engines (RICEs), turbine engines and turboshaft engines.

BACKGROUND

Nozzles are key components of internal combustion engines for organizing and controlling the combustion process. Currently the publicly known nozzles of diesel engines include the following two types: needle type and hole type. Needle type nozzles are used in indirect injection combustion chambers, with which unblocked spray holes are ensured. However, the resulted fuel lines are thicker, and thus the atomization effect is not as good as that of hole type nozzles. As a consequence, needle type nozzles have gradually been substituted by hole type nozzles. Hole type nozzles are used in direct injection combustion chambers, and the resulted atomization quality is better than that of needle type nozzles. However, the spray holes of hole type nozzles are of small diameters, and thus easily blocked during operation. Therefore, hole type nozzles impose a high requirement for fuel quality. Besides, hole type nozzles spray in a manner of liquid columns, which, when injected from a few fixed spray holes, result in relatively large dead angles and a higher penetration level. This leads to the problem of spray-wall interaction (i.e., wetted wall), which is not only hard to overcome, but manifested in uneven fuel distribution and ununiformed sizes of atomized particles, preventing the fuel from being gasified fully and combusted uniformly. This is the main reason why direct injection diesel engines can hardly realize high homogeneous charge compression ignition and low temperature combustion, and thus give rise to high levels of $NO_X$, soot and PM emissions. Additionally, a conical-spray nozzle is also available, whose advantages include high injection speed, fine and uniform atomized particles and macroscopically uniform circumferential spray distribution. A disadvantage of the conical-spray nozzle lies in the fact that much of the kinetic energy of atomized particles is lost due to the impact of the fuel column with a guidance cone, resulting in excessively low spray penetration. For this reason, under medium- or low-load conditions, conical-spray combustion engines exhibit lower specific fuel consumption, lower smoke intensity and lower exhaust air temperature than those of traditional engines, and their performance is deteriorated under high-load conditions. A cross sectional area of a fuel column is extended due to the impact with the guidance cone; when there are too many fuel columns involved in the spray, the fuel columns may interfere with each other, resulting in larger oil particles condensed from oil drops at the intersections of the fuel columns, which leads to insufficient combustion, formation of soot and serious after-burning.

To solve these problems, measures are generally adopted at present such as using finer spray holes, increasing the number of spray holes and employing a high pressure injection. However, three problems that are hard to solve are resulted, as follows:

1. As the diameter of spray holes is further reduced, some spray holes have a diameter of ϕ0.08 mm or even smaller. Too small spray holes are easier to be blocked, while technical difficulty and cost of manufacturing is increase. Furthermore, a more critical requirement for the quality of the fuel is imposed. The reduction of the spray hole diameter is limited by injection duration and penetration rate. In particular, although the vortex is made stronger as the engine spinning speed is increased, the achievable degree of homogenization is actually lowered as the absolute time for producing the gas mixture is shortened. Under the condition of ultra-high-pressure injection, an intense high-frequency pressure oscillation occurs in the pressure chamber, which causes "bubbling" (i.e., cavitation) inside the superfine spray holes. The flow state inside the spray holes is thus influenced, which in turn affects the flow state near the spray holes as well as the atomization of the oil drops.

2. As the number of spray holes is increased substantially (sometimes as many as 17 spray holes), the resulted large number of oil lines may be quite close to each other, causing a relatively higher concentration of fuel at the roots of the oil lines. For the oil lines that are farther apart, they can interference with each other under the effect of the air flow inside the combustion chamber. In some areas, small oil particles may thus be combined and affect the atomization quality, leading to local areas having excessively enriched fuel that aggravates the pollutant emission.

3. Ultrahigh pressure injection is subjected to limitations imposed by the maximum common rail pressure of the fuel supply system. Limited by the strengths of parts involved as well as the driving energy of the fuel pump, ultrahigh pressure injection may cause complexity and dangerousness to the fuel supply system, even to an unbearable extent. An increase of supplementary loss of engine energy may also be resulted.

In order to cope with increasingly severe environmental and energy problems, in recent years attentions have been drawn to studies of combustion theories and techniques to be employed by next-generation internal combustion engines that are most promising for realizing ultra-low or even zero emission. These combustion theories and techniques include homogeneous charge compression ignition (HCCI) and low temperature combustion (LTC). Different from traditional spark ignition gasoline engines and diesel engines that are directly controlled via in-cylinder direct injection, a HCCI engine has a spontaneous ignition combustion process, which is achieved by compressing the gas mixture in the cylinder under both the ignition limit and the stable combustion limit.

Various study models and methods have been adopted in creating conditions for HCCI operation, such as: increasing temperature and pressure in the cylinder by using external and internal heat sources, applying fuel with an especially low octane value, utilizing premixed charge compression combustion and employing variable compression ratio and variable valve timing, etc. However, they share some similar common problems, most eminent of which lies in the difficulty in controlling the ignition time and the combustion rate. As a consequence, HCCI operation under a wide range of spinning speed and across various load conditions is yet to be realized satisfactorily.

Therefore, for realizing satisfactory HCCI, new fuel injection techniques and atomization methods are to be studied and developed to solve the following three problems:

1. How to realize an advanced gas mixture control strategy?

HCCI process is mainly subject to chemical kinetic control of the gas mixture, whose rapid formation is enforced. Hence, typical HCCI fuel atomization of gasoline engines and diesel engines at present generally adopts in-cylinder direct injection. From studies pertaining to HCCI lean premixed combustion and low temperature premixed combustion, it is found difficult for internal combustion engines to realize fully homogeneous gas mixture. It is also found that HCCI is not, and not possible, to be absolutely uniform. This is because gas mixture control is a dynamic control. Even in a static state, fuel particles in a gas mixture premixed outside the cylinder can be naturally subsided, absorbed and combined with each other due to gravity as their mass is greater than that of air molecules. Given that the mass of oil drops is far greater than that of air molecules, the oil drops exhibit irregular turbulent fluctuations under the effect of air flow movement in the cylinder after entering the combustion chamber, and move at a speed far greater than that of the air molecules. The speed of relative movement makes the oil drops separated from the air molecules. Separated by the relative speed, the oil drops, which have a larger mass and thus accelerate faster, may collide, concentrate, absorb and combine with each other at a farther place to form an over-rich area and result in thermal stratification. After entering the combustion chamber, oil drops with higher mass and higher density can penetrate through air molecules with lower mass and lower density to impact on the cylinder wall and an end face of piston. If oil supply is not increased or an air inlet is not heated using an external heat source to increase temperature in the cylinder and facilitate evaporation of oil drops, the internal combustion engine will suffer from low temperature and poor cold start performance, and mixing speed and combustion speed will be lowered significantly. Theoretical analysis as well as a large number of tests have proved that the time needed to burn an oil drop is directly proportional to square of the diameter of the oil drop. Rather large differences between sizes off atomized particles can also significantly influence the uniformity of combustion speed and temperature. Currently, regardless of gasoline engines or diesel engines, air inlet injection or in-cylinder direct injection, there exists a common problem: the fuel atomization is of fuel spray type (i.e., liquid column) injection, which is a passive atomization rather than an initiative atomization. Kinetic penetrating force of oil column type injection of high pressure fuel is concentrated on several fuel sprays, resulting in that fuel distribution and atomized particle sizes are not uniform, that the drawback of formation of oil mist over-rich areas and high temperature areas cannot be overcome for sufficient gasification, and that additional spray-wall interaction (i.e., wetted wall) can be caused easily to generate carbon deposition and diluted engine oil. For oil column type injection of hole type nozzles, numerous studies have demonstrated that even under conditions of ultrahigh pressure and superfine spray holes, mist spray formed by diesel fuel in the combustion chamber is in an oxygen-poor or over-rich state (usually 4 times richer than theoretical stoichiometric ratio). Such anoxic state under high temperature exactly helps generation of polycyclic aromatic hydrocarbons (PAHs), which is the cause of soot generation. Combustion of traditional diesel engines is "diffusive combustion under theoretical equivalence ratio". According to chemical kinetic theories, combustion flame under theoretical equivalence ratio has the highest temperature, up to 2700K, and is accompanied by the maximal nitric oxide ($NO_X$) generation rate. Therefore, to realize an advanced gas mixture control strategy, the traditional oil column type injection method must be changed.

2. How to solve the problem of HCCI cyclical fluctuation under high compression ratio, high speed and high load?

As HCCI is tended to be rapid combustion and is sensitive to gas mixture temperature and likely to fluctuate cyclically, it is hard to be controlled and is currently limited in low load and medium and-low speed operation areas, rather than high compression ratio, high speed and high load conditions. Therefore, it is necessary to improve the fuel injection method and atomization method to further enhance robustness of HCCI to prevent cyclical fluctuation resulted from alternate knocking and fire.

3. How to solve the problem of atomization time control and accurate ignition?

HCCI of gasoline engines and diesel engines similarly have some common problems, mainly ignition time and combustion speed controls. Due to these problems, HCCI is hard to operate under extensive spinning speeds and loads, and fuel consumption may even be worsened; thus, HCCI cannot meet GB IV (Euro IV) and above laws and regulations. To ensure reliable ignition and combustion control accuracy, various HCCI feedback controls have been discussed and researched, including cylinder pressure sensor, ionic current sensor, bent axle acceleration signal and knocking sensor etc., which are all problematic to some extent. Meanwhile, as atomization time and accurate ignition electronic control system is complex and costly, the difficulty of HCCI engine industrialization may be increased. Therefore, an enforced accurate ignition control means and a reliable low cost solution are needed.

It is currently known that turbine and turboshaft engines use an open centrifugal nozzle or a centrifugal oil flinger, differing from hole type and needle type nozzles used by reciprocating internal combustion engines. As no device for directly opening and closing spray holes is provided inside the centrifugal nozzle or centrifugal oil flinger, spray holes are always open. Structurally, centrifugal nozzles include simple centrifugal nozzles, double oil way double spray opening centrifugal nozzles and double oil way single spray opening centrifugal nozzles. Centrifugal nozzles generally have good atomization performance and large atomization spray cone angle. Hollow umbrella-like oil mists in the centre are easy to mate flow field of air in the combustion chamber. However, centrifugal nozzles have the following drawbacks: (1) For simple centrifugal nozzles, their adjustable range of fuel flow is much narrow under maximum injection pressure drop. As the size of tangential holes is steady, when fuel injection quantity is reduced, the speed of fuel flowing into a spin chamber is certain to be decreased significantly. Consequently, the tangential speed of fuel flowing away from the spray opening can be decreased significantly, thereby leading to serious deterioration of atomization quality. (2) Two independent simple centrifugal nozzles are substantially connected in series for combined operation in a double oil way double spray opening centrifugal nozzle; therefore, the adjustable range of fuel flow is far greater than that of one simple nozzle. However, the double oil way double spray opening centrifugal nozzle has a drawback that when a second main oil way is put into operation in the beginning, atomization quality will be deteriorated in a moment as the starting injection pressure is rather low. (3) Regarding double oil way single spray opening centrifugal nozzles, their adjustable range of fuel flow is much wide. However, their drawback lies in that the two oil ways will interference with each other; due to back pressure, when a second main oil way is put into operation, spinning speed of oil flow in the spin chamber is slowed, so that atomization quality of fuel is seriously deteriorated. Besides, a centrifugal nozzle, whose structure is rather complex and whose tangential holes (grooves) have adjustable area, is further provided. The abovementioned centrifugal nozzles can extend the adjustable range of fuel flow to some extent and properly improve oil atomization quality under low load. However, when the second main oil way is put into operation in the beginning, atomization quality will always be deteriorated obviously and fuel injection quantity will sharply jump in a moment. Meanwhile, the adjustable range of fuel flow, restricted by the variation range of injection pressure, cannot be increased significantly. The spraying, opening and closing of such centrifugal nozzles are achieved by starting and stopping a fuel pump. One or two oil supply pipes are provided between the oil pump and the nozzle. When the oil pump is stopped after the engine is shut down, as spray holes of the centrifugal nozzle are open all the time, fuel from the oil pump to the nozzle will be automatically fully discharged through spray holes from the oil supply pipe and the nozzle, so that the oil supply system will be placed under an oil-free hollow state. When the engine is started again, the fuel pump needs to further fill fuel into space between the empty oil supply pipe and the nozzle so that fuel can reach the spray holes. Fuel pressure is slowly rising in a temporary process. It is lowered instantly when the engine is started, the injection pressure of starting atomization pressure drop is lower than a critical value, thus oil pressure is much low at the beginning of injection. As the centrifugal nozzle starts injecting before fuel pressure reaches a rated pressure value, the atomization and combustion effects are not acceptable, and problems such as exhaust fuming and slow starting response are resulted. Main components of small granular substances contained in the exhaust soot from insufficiently combusted fuel include carbon granules and trace amounts of metal salts etc., which will increase carbon depositions on a flame tube, a combustion box and a turbine blade, leading to lower working efficiency. Carbon deposition can separate metal surfaces of the flame tube, the combustion box and the turbine blade from cold air, causing local overheating in a large area and leading to local heat stress, warping, deformation and cracks. Additionally, carbon deposition can block some nozzles, so that when the engine is operated, non-uniformity of the front temperature field of a turbine is enlarged, and the flame direction is not parallel to the axis of the combustion chamber; therefore, the combustion process of the combustion chamber can be destroyed, and a guidance blade and an operating blade of the turbine can be burnt down to cause accidents. When most nozzles are blocked, the engine can be stalled or automatically stopped, thus endangering air vehicles. Some turboshaft engines adopt a centrifugal oil flinger to supply oil. Centrifugal oil flingers can ensure sufficient atomization of sprayed fuel, and is simple in structure, light in weight and convenient in maintenance. However, the spray holes are likely to produce carbon deposition after the engine has run for a long time and every time when it is started; thus, some spray holes can be blocked, thereby leading to the reduction of oil supply and accordingly lowered engine power. In a serious case, engine speed will oscillate on the ground or cannot reach normal maximum speed. During a flight, when pitch is increased or reduced instantly, the engine cannot recover its constant speed rapidly, so that when a throttle is advanced or retarded, the engine will be vibrated in a pulsatory manner and the body of the engine will be shaken. In a starting process, when 60% to 80% of the cross area of the spray holes is blocked, the oil supply pressure will be severely insufficient, thus the engine speed will be limited. The main cause that carbon deposition is likely to occur to block the present centrifugal nozzles and centrifugal oil flingers is that the spray holes cannot be closed directly, so that after the engine is shut down, when automatically discharged through the spray holes from the oil supply pipe and the nozzle between the oil pump and the nozzle, the fuel is evaporated, decomposed, absorbed and subsided repeatedly for a long time to become hard and thick under the high temperature environment remained in the combustion chamber that has not been cooled yet.

Publication Patent Number: CN818372A is a conical-spray nozzle with a needle valve head protection cover. According to the technical scheme of the patent, a fuel injection method is achieved by enabling high pressure fuel to impact on the head of the needle valve. Due to simple impact injection, some fuel is splashed into the protection cover and oil particles are combined, thus leading to high loss of kinetic energy, low spray penetration and deteriorated combustion under high load. Publication Patent Number: CN201092922Y is a vortex conical-spray nozzle. According to the technical scheme of the patent, high pressure fuel needs to pass through a symmetrical tangential oil feed groove provided along the wall of a pit through an annular gap between the nozzle and an outer circle to form a vortex in the planar pit before it is sprayed through the spray hole at the front end of the nozzle. The fuel flow process has more than one turn, which results in high resistance and weakens the vortex. The planar pit cannot self-clean; thus, too much fuel is remained and permanent carbon deposition is likely to be produced under high temperature. The central hole of the nozzle and the outer circle constitute an interference fit. As their expansion factors are different, the central hole of the nozzle is likely to be loosened and fallen off under high temperature and high pressure. Publication Patent Number: CN2173311Y is a liquid injection atomizing nozzle. According to the technical scheme of the patent, when liquid fuel, under the high pressure of an oil pump, passes through a plurality of spiral grooves that are uniformly distributed on the cylindrical surface of a plunger piston at the lower end of a needle valve, a slant reacting force will be generated upon the spiral grooves to push them to drive the needle valve to rotate reversely, so as to counteract atomization of the spiral grooves. The tooth-shaped cylindrical contact surface of the spiral grooves is not a smooth cylinder, so that movable fit sealing clearance is hard to be ensured between the contact surface and the inner circle of the body of the needle valve. Due to spiral slant injection, the atomization cone angle of fuel is relatively small, the burning centre is forwarded, and the flame is rather long, thus restricting the running load of the engine. The fuel passage of the spiral grooves is long and shallow, so that fuel faces high resistance for flowing and injection. Publication Patent Number: CN1204747A is a return flow type mechanical atomizing nozzle. According to the technical scheme, no needle valve is provided and correct time injection cannot be controlled, so that the nozzle cannot be applied to a reciprocating internal combustion engine. Further, as the spray hole of the nozzle is open and cannot be closed directly, when the nozzle is used in turbine and turboshaft engines and a gas turbine, a problem cannot be solved that fuel is drained from an oil supply pipe after the engine is shut down, thus leading to low fuel pressure at the beginning of injection, affected atomization and combustion effects, exhaust fuming, slow starting response and apt carbon deposition. Publication Patent Number: CN101368740A is a closed pulsatory centrifugal nozzle. According to the technical scheme of the patent, if the diameter of spray holes is increased when a high power heavy-duty engine has high cyclical fuel injection quantity, a fuel film may be thickened and atomization quality can be affected.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

To solve the abovementioned problems, the present disclosure aims to find a new approach by means of technological recombination and functional innovation, and designs and develops a centrifugal conical-spray nozzle, whose major technical characteristics are: a needle vale (5) is arranged in the centrifugal nozzle; the head portion of the needle valve (5) is provided with a throttling guidance cone (13); a needle valve body (1) is internally provided with a lining (4); and the lining (4), oil feed passages (3, 6), a pressure chamber (8), tangential holes (9), a spin chamber (10), a spray hole (11) and a spray opening (12) are integrated. According to the technical scheme, technical characteristics are correlated and supported mutually, the centrifugal conical-spray nozzle realizes new function and technical effect, overcomes the defects of the prior art, and respectively solves problems occurring in nozzles used by reciprocating internal combustion engines and turbine and turboshaft engines.

BRIEF DESCRIPTION OF THE DRAWINGS

In the drawings:

FIG. 1: the device comprises a needle valve body (1); the needle valve body (1) is provided with positioning holes (2, 7); the needle valve body (1) is internally provided with a lining (4), a needle valve (5), oil feed passages (3, 6), a pressure chamber (8), tangential holes (9), a spin chamber (10) and a spray hole (11); the lining (4), the oil feed passages (3, 6), the pressure chamber (8), the tangential holes (9), the spin chamber (10), the spray hole (11) and the spray opening (12) are integrated; the head of the needle valve (5) is provided with a throttling guidance cone (13).

In FIG. 1, the needle valve (5) is at an opened position of a fuel atomization state.

DETAILED DESCRIPTION OF THE PREFERRED EMBODIMENTS

Figure 1:
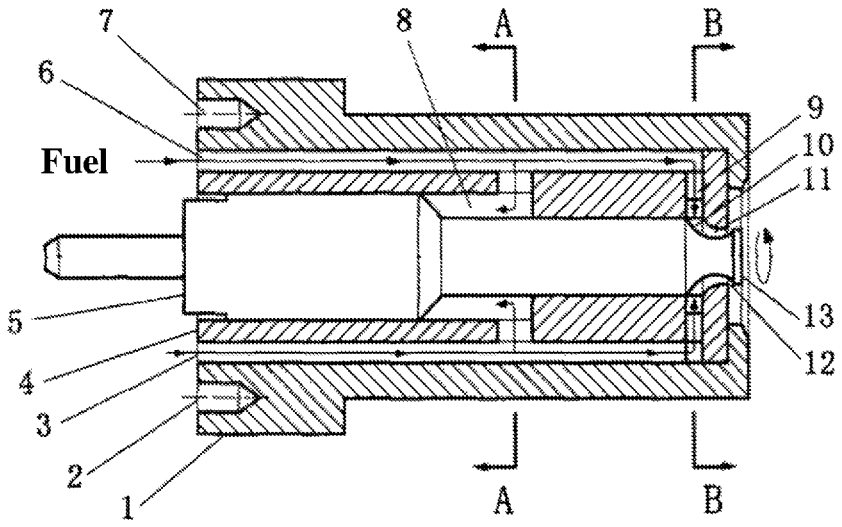
FIG. 1 is a sectional structural drawing of matching parts of a centrifugal conical-spray nozzle; in the drawing, a needle valve (5) is at an opening position of a fuel atomization state.
Figure 2:
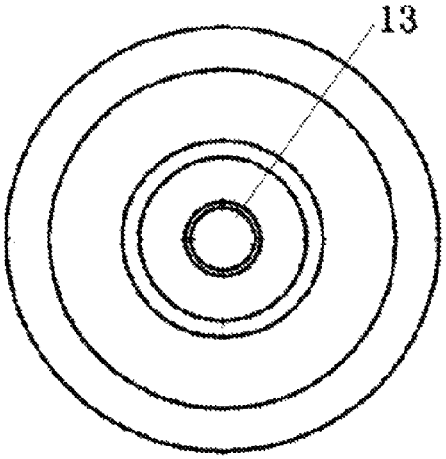
FIG. 2 is a right side view of FIG. 1.
Figure 3:
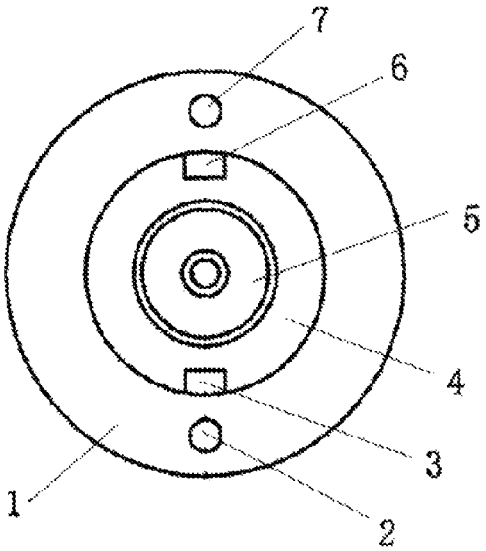
FIG. 3 is a left side view of FIG. 1.
Figure 4:
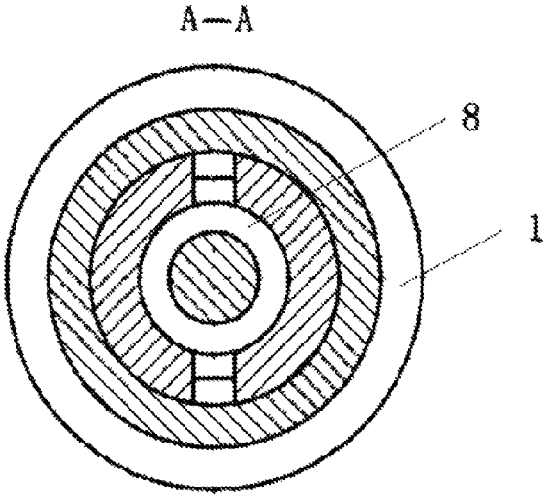
FIG. 4 is a sectional view of FIG. 1 along A-A.
Figure 5:
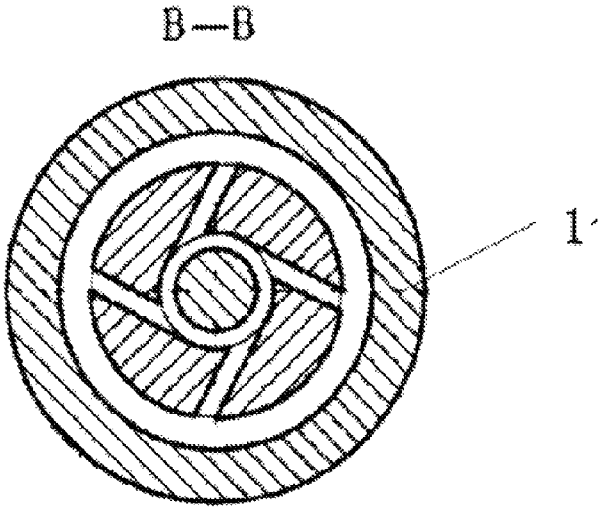
FIG. 5 is a sectional view of FIG. 1 along B-B.
Figure 6:
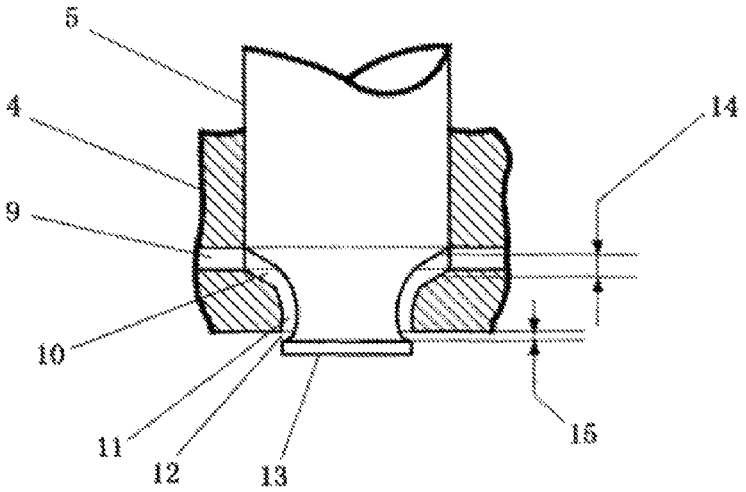
FIG. 6 is a partial enlarged drawing of a lining (4), a needle valve (5), tangential holes (9), a spin chamber (10), a spray hole (11), a spray opening (12), a throttling guidance cone (13), a needle valve lift (14) and a spray opening diameter (15) of a device according to an embodiment of the present application; in the drawing, the needle valve (5) is at an opened position for a fuel atomization state.

The present disclosure aims to provide a new fuel atomization method and structural design for a reciprocating internal combustion engine through the technical scheme of centrifugal conical-spray, wherein straight injection penetrating force is changed into a spinning force, and wherein liquid column breakup of fuel is changed into liquid film breakup. Thus, the spray holes (11) inject neither separate fuel sprays nor oil mists generated by collision, but a rotary umbrella-like atomized fuel film which has no compact fuel spray core and has a controllable penetration distance. Under the same injection pressure, indicators such as average atomized particle size, Sauter mean diameter and particle size distribution are better than oil column injection indicators of hole type and needle type nozzles, thereby increasing fuel-air mixing area to realize relatively extensive rapid mixing, improving fuel distribution homogeneity to facilitate rapid heat release, and shortening fuel spray penetration to avoid spray-wall interaction, improve injection atomization quality and combustion efficiency, reduce pollutant discharge, prevent the spray holes (11) from being blocked and prolong the service life of the nozzle. According to the patent, a rotary umbrella-like fuel film spray guidance method is adopted for HCCI gasoline engines; fuel is injected not in the intake process, but when the compression travel approaches the upper dead centre. Differing from wall surface guidance and air flow guidance passive fuel atomization of lean premixed combustion and low temperature premixed combustion, the rotary umbrella-like fuel film spray guidance method is an initiative fuel atomization method and is almost quality regulation of diesel engines, so that ignition phase and combustion speed can be controlled accurately, and problems, such as instable combustion, large cyclical fluctuation, ignition occurring after the upper dead angle, knocking and fire alternation and large fluctuations of spinning speed and output torque when HCCI is in a critical state, are solved. When high compression ratio is adopted, as the compression process is proceeded, air pressure and temperature in the cylinder are constantly rising; air temperature near an ignition starting point in the upper dead centre can reach up to more than 600° C., above the auto-ignition temperature (300 to 400° C.) of gasoline fuel under the pressure of the time. Oil drops can be rapidly heated up by heat energy released from kinetic energy produced by the umbrella-like fuel film rotated at a high speed during high pressure injection, through friction, impact, penetration and mixing with the high compression ratio air with comparatively higher density, viscosity and resistance in a large area. Thanks to high temperature cumulative effect released by small bubbles when surface tension and cohesion of fuel particles that are uniformly distributed are broken and heat energy released from energy conversion after air molecules are compressed sharply, heat release rate can exceed cooling rate and pre-flame temperature can rise to evaporation boiling point of oil drops, so that chained heating ignition can be achieved, gas mixture self-ignition and multipoint simultaneous ignition can be realized, and the problem of controllable CI (compression ignition), ignition time and combustion speed is solved. At low temperature and cold start stages, a sparking plug can be adopted to assist ignition and ensure ignition reliability. The high speed spinning umbrella-like fuel film atomization method used for HCCI of diesel engines solves the problem of controllable HC (homogenous charge). By utilizing the technical scheme and injection strategy of high pressure centrifugal injection (having a better effect than more dense spray holes or similar conical-spray nozzles of lean burn GDI gasoline engines simply resorting to extrusion and impact injection) and pulsatory needle valve controlled atomization time and ignition time (using no feedback control and superior to complex and costly electronic control systems), the patent provides a reliable low-cost HCCI solution to realize homogenous compression ignition and full-course enhanced mixing in combustion, prevent spray-wall interaction (wetted wall), control atomization time and ignition time accurately, ensure combustion stability and extend HCCI operation areas, etc. Meanwhile, through this technical scheme, the patent provides for centrifugal nozzles of turbine and turboshaft engines a control structure and a method, which extends the adjustable range of fuel flow and can directly automatically open and close spray holes, thereby solving problems of the present open centrifugal nozzles that the adjustable range of fuel flow is small, spray holes cannot be closed directly, fuel drains after shutdown and fuel injection pressure is low at the beginning of start, thus which results in affected atomization and combustion effects, exhaust fuming, slow starting response, increased carbon deposition and apt blocking.

The purpose of the present disclosure is realized as follows: a needle valve (5) located in a nozzle needle valve body (1) reciprocally is slid with the change of fuel pressure of an oil pump; a seat surface (16) of the needle valve (5) mates a seat surface (17) of a spin chamber (10), thereby directly opening and closing a spray hole (11) and a spray opening (12) at the central front end of the spin chamber (10) in a pulsatory manner, so as to ensure correct time injection; a plurality of tangential holes (9) are uniformly distributed between a pressure chamber (8) in the needle valve body (1) and the spray hole (11); fuel with a tangential force gains a tangential moving speed when leaving the spray hole (11) after being spun in the spin chamber (10); under the action of a tangential centrifugal force, oil flow is sprayed through the spray opening (12) to form an umbrella-like atomization fuel film which spins at a high speed; the fuel film is quickly broken up into fuel particles under the action of external forces (movement and reacting force of air flow in the combustion chamber) to form fuel-air mixture; when injection is stopped, the seat surface (16) of the needle valve (5) seals the tangential holes (9), the spin chamber (10) and the spray hole (11) entirely, and plays a role in self-cleaning for cleaning carbon deposition to prevent blocking; when injection is started, as the needle valve (5) is risen and moved upwards, the cross area of the tangential holes (9) is gradually developed, and fuel injection quantity is accordingly gradually increased; under low speed spinning, oil supply pressure is maintained; cyclical fuel injection quantity is reduced; restricted by a pressure spring of a fuel injector, the rising and sustaining time of a needle valve lift (14) are shortened, the rising and sustaining time of the lift of the seat surface (16) of the needle valve (5) are accordingly shortened, and the developed cross area of the tangential holes (9) and the volume of the spin chamber (10) are simultaneously reduced, so that the entrance speed of fuel entering into the spin chamber (10) is increased, the fuel is spun more intensely, and the tangential speed at the outlet of the spray hole (11) is accordingly increased; meanwhile, as the developed cross area of the tangential holes (9) and the volume of the spin chamber (10) are reduced, flowing resistance of fuel in the oil supply pipe is correspondingly increased, thus fuel volume is correspondingly abruptly reduced, and injection pressure and flow rate are improved, so that when leaving the spray hole (11) and the spray opening (12) through the spin chamber (10), fuel still can have sufficient tangential speed and spinning intensity; at an injection ending stage, as fuel injection pressure is lowered, fuel injection speed is lowered and internal negative pressure of oil mists is reduced, the trend that oil mists are contracted to the centre is reduced, and the atomization angle is increased slightly; in this process, due to interaction between spring pressure of the fuel injector and fuel pressure, the needle valve (5) is slid reciprocally from top down, the needle valve lift (14) is changed constantly, and the opening degree by the cross area of the tangential holes (9) and the volume of the spin chamber (10) is changed constantly; even when cyclical fuel injection quantity is low under low load, oil flow still can have a rather high tangential speed in the spin chamber (10), thereby ensure good atomization quality of fuel all the time. Therefore, the adjustable range of fuel flow is much wide to meet the requirements of reciprocating internal combustion engine and turbine and turboshaft engine units for constant acceleration and a full load range.

According to the present disclosure, as the atomization method is changed, fuel has a tangential penetrating force and a spinning force when leaving the spray hole (11) and the spray opening (12), and turbulent fluctuation and air flow entrainment of fuel flow are more intense than those of non-spinning; therefore, the atomization quality is better than that of the currently known needle type, hole type and conical-spray nozzles which resort to impact injection simply by an extrusion force. Rays formed by fuel under the action of the penetrating force and centrifugal force are distributed within 360° along the bottom circle of a hollow atomization cone. Actually, finite fuel sprays in one or more than one fixed direction that needle type and hole type nozzles can achieve are split into a number of thinner fuel rays. When the high speed spinning umbrella-like fuel film is injected from the annular section of the spray hole (11) and the spray opening (12), the front part of a throttling guidance cone (13) is a gas vortex. As the spray hole has a large equivalent area, fuel injection friction and release resistance of surface tension and cohesion are reduced, and injection flow at equal time is increased, so that fuel rays are speeded up, and grain fineness, uniformity and homogeneity are better, thereby not needing to greatly increase the pressure of the present suited fuel injection pump. Under the same cyclical fuel injection quantity, injection speed improving can help prolonging of absolute time for the formation of gas mixture, and increase combustion speed and end combustion in advance so as to save more time for fuel expansion process and reduce oil consumption; exhaust finishing temperature is low, and low temperature and cold start performances are good. As the diameter of the spray hole (11) is correspondingly increased and fuel flowing friction and resistance are reduced, injection duration is shorter than supply duration, and maximum injection speed is greater than maximum supply speed; the fuel injection rule is demonstrated as a slow initial term, a rapid medium term and a quick and short late term. Relieving of fuel injection pressure can solve the defects of the currently widely used high pressure common rail fuel injection system, such as low "tolerance" to fuel quality, comparatively high system cost, various control variables and long product development period. As the umbrella-like fuel film in the present disclosure is tangentially spun and freely injected, differing from that injected by a conical-spray nozzle by extruding and impacting on the guidance cone, impact on the guidance cone and fuel spray splashing are prevented, thereby resulting in low kinetic energy loss of fuel sprays and oil particles and preventing too low penetration rate resulted from large windward area. The radian of a transitional cambered surface (18) of the throttling guidance cone (13) and a corresponding transitional cambered surface (19) of a lining (4), as well as an injection guidance angle (21) at the spray opening (12) of the throttling guidance cone (13), can influence and control a rotary hollow fuel film atomization cone angle (22). The diameter (15) of the spray opening (12) can be adjusted to adjust and control fuel film thickness. The cross area of an annular section (2) formed in the gap between the outer diameter of the transitional cambered surface (18) of the throttling guidance cone (13) and the inner diameter of the corresponding transitional cambered surface (19) of the lining (4) can be increased or reduced by simultaneously increasing or reducing the diameter of the outer circle and the inner circle of the annular section (20), thereby adjusting and controlling the cyclical fuel injection quantity of the spray hole (11) and the injection opening (12) and controlling fuel film injection thickness. The spinning umbrella-like fuel film remedies the dead angle among the oil column type injection fuel sprays, enhances fuel distribution space and uniformity, greatly increases the fuel-air contact area, prevents local over-rich areas, and accelerates heat absorption and gasification, thus ensuring sufficient reaction time for the gas mixture. Under the same cyclical fuel injection quantity and fuel injection speed, thanks to improved area and speed, shortened time and increased quantity of gasified and heat-absorbing fuel for gas mixture formation, the negative value of the pre-ignition heat release curve is prolonged, and the heat release starting point in the lag period (delay period) and rapid period of ignition is put off. During the slow and late ignition periods, fuel injected subsequently is still maintained as an umbrella-like fuel film that spins at a high speed; it has a stable homogenous distribution characteristic and is ignited nearly at the same time of the rapid ignition time, thereby preventing the non-homogenous characteristic in the pre-mixed combustion stage and the diffusive combustion stage, preventing the problem that a great number of $NO_X$, soots and PM are generated as the heat release speed of oil column injection is first high and then low and the gas mixture at root of fuel sprays during the slow and rapid ignition periods is excessively rich and oxygen-poor and evaporation and atomization mainly rely on the high temperature of the lag and rapid ignition periods, thereby ensuring more sufficient combustion of oil drops, improving the heat efficiency and economic performance of engines, and reducing pollutant discharge. The late ignition period and the heat release maintaining period are shortened, which is good to reduce combustion noise and vibration, lower combustion roughness and prevent the unique phenomenon of "two peaks" occurring in diesel engine combustion. To solve the problem that as HCCI is tended to be rapid combustion, sensitive to gas mixture temperature and likely to fluctuate cyclically, it is hard to be controlled, limited to low load and medium and-low speed operation areas currently, cannot fully meet the requirement of HCCI operation under extensive spinning speeds and loads, and cannot be applied within entire operation of engines, a new method is provided.

The present disclosure also provides for turbine and turboshaft engines a new structure and a new method for extending the adjustable range of fuel flow. According to the present disclosure, the spray hole can be directly automatically opened and closed, thereby solving problems such as affected atomization and combustion effects, exhaust fuming and slow starting response as the injection pressure of starting atomization pressure drop is lower than critical value and fuel pressure is too low at the beginning of injection when turbine and turboshaft engines are started again after fuel in the oil supply pipe and the nozzle are automatically drained through the spray hole, improving the starting sensitivity of the engine, shortening the starting time of the engine, reducing carbon deposition generated in a flame tube, a combustion box and a turbine blade, preventing the nozzle from being blocked, and improving safety and working efficiency of air vehicles.

According to the present disclosure, as the seat surface (16) of the needle valve (5) directly mates the seat surface (17) of the spin chamber (10), oil supply can be started and closed reliably and effectively, and every time when injection is finished, remaining fuel between the spray hole (11) and the needle valve (5) can be minimized. The transitional cambered surface (18), at the spray hole (11), of the throttling guidance cone (13) at the head of the needle valve (5) and the transitional cambered surface (19) of the lining (4) at the spray hole (11) prevent the fuel sprays tangentially spun through the tangential holes (9) and the spin chamber (10) from impacting on the throttling guidance cone (13), and play a role in guiding round transition of oil flow and accelerating tangential spinning. The area of the annular section (20), formed in the gap of the spray hole (11) from the outer diameter of the transitional cambered surface (18) of the throttling guidance cone (13) to the inner diameter of the corresponding transitional cambered surface (19) of the lining (4), can be adjusted to control cyclical fuel injection quantity. Fuel film injection thickness can be controlled by the diameter (15) of the spray opening. The injection guidance angle (21) at the spray hole (11) of the throttling guidance cone (13) can adjust the spinning atomization cone angle (22). Nozzles for reciprocating internal combustion engines and turbine and turboshaft engines are precision control devices which operate in a high speed, high temperature and high pressure environment; a tiny difference can lead to large differences in operation quality and energy conservation of units. According to the technical scheme of the patent, the lining (4) is integrated with the oil feed passages (3, 6), the pressure chamber (8), the tangential holes (9), the spin chamber (10), the spray hole (11) and the spray opening (12), thereby closing flow ways that may affect atomization quality and cause oil leakage and channelling under ultrahigh pressure and ultra-short pulse fuel injection inside the nozzle, and reliably, effectively and significantly solving the challenge of sealing for overall cooperation of the oil feed passages (3, 6), the pressure chamber (8), the tangential holes (9) and the spin chamber (10), the movable fit between the needle valve (5) and the lining (4) and the stationary fit between the needle valve body (1) and the lining (4). The present disclosure provides a new gas mixture organization and control method and an injection automatic opening and closing structure for HCCI of reciprocating internal combustion engines, and also provides the centrifugal nozzle of turbine and turboshaft engines with a structure and a method, which can extend the adjustable range of fuel flow and directly automatically open and close the spray hole, thereby avoiding fuel leakage, improving starting sensitivity and atomization quality and preventing the spray hole from being blocked by carbon deposition.

The working principle is as follows:

When pressure fuel from an oil pump enters into the pressure chamber (8) through the oil feed passages (3, 6) between the needle valve body (1) and the lining (4) and reaches a rated pressure, the fuel drives the needle valve (5) to move backwards to open the spray hole (11), and meanwhile enters into the tangential holes (9) and subsequently into the spin chamber (10) as driven by a tangential force, generating a circumferential spinning movement therein. The fuel is then injected from the spray opening (12) through the spray hole (11) under an action of a tangential centrifugal force, thereby forming an umbrella-like atomized fuel film that spins at a high speed. The fuel film is quickly broken up into small oil particles under an action of external forces (i.e., air flow movement and reaction force thereof in the combustion chamber), thus forming an fuel-air mixture.

Figure 7:
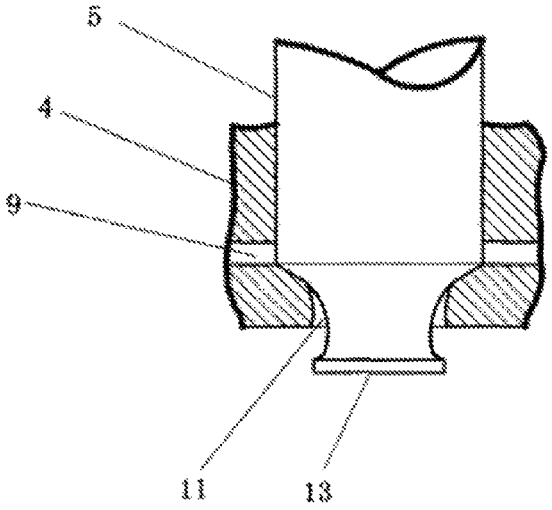
FIG. 7 is a partial enlarged drawing of a lining (4), a needle valve (5), tangential holes (9), a spray hole (11) and a throttling guidance cone (13) of a device according to an embodiment of the present application; in the drawing, the needle valve (5) is at a closed position for stopping a fuel atomization state.
Figure 8:
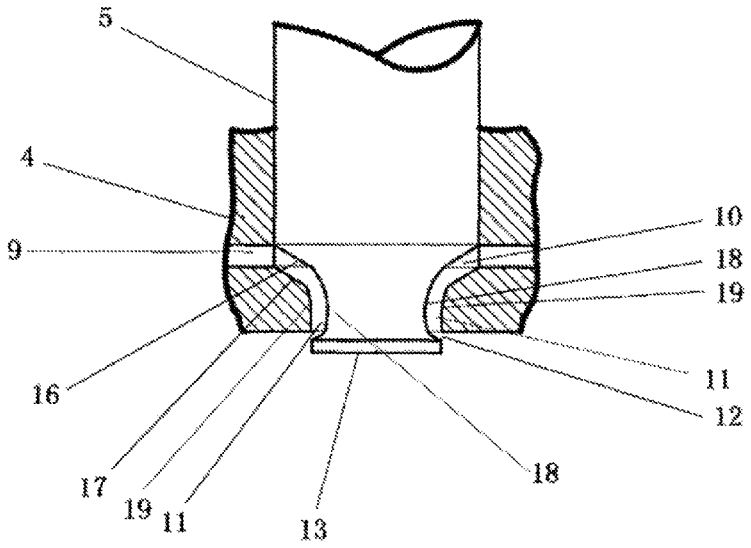
FIG. 8 is a partial enlarged drawing of a lining (4), a needle valve (5), tangential holes (9), a spin chamber (10), a spray hole (11), a spray opening (12), a throttling guidance cone (13), a seat surface (16) of the needle valve (5), a seat surface (17) of the spin chamber (10), a transitional cambered surface (18) of the throttling guidance cone (13) at the spray hole (11) and a transitional cambered surface (19) of the lining (4) at the spray hole (11), of a device according to an embodiment of the present application; in the drawing, the needle valve (5) is at an opened position for a fuel atomization state.
Figure 9:
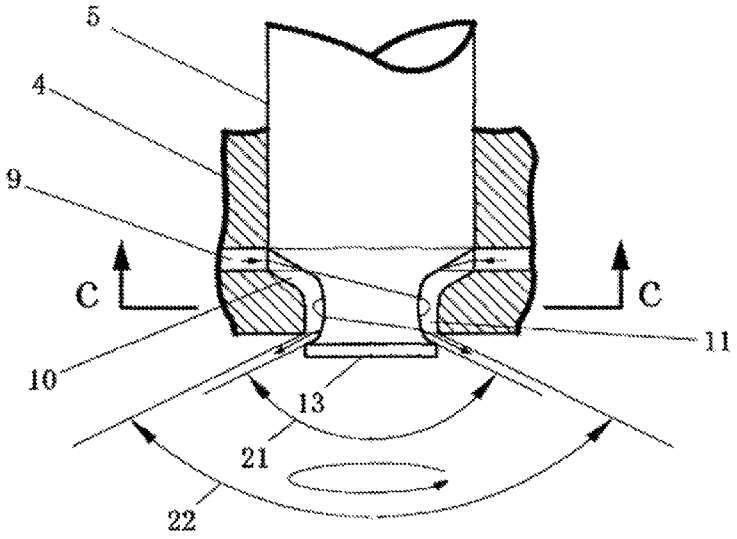
FIG. 9 is a partial enlarged drawing of a lining (4), a needle valve (5), tangential holes (9), a spin chamber (10), a spray hole (11), a throttling guidance cone (13), an injection guidance angle (21) of the throttling guidance cone (13) at a spray opening (12) and a rotary spray cone angle (22), of a device according to an embodiment of the present application; in the drawing, the needle valve (5) is at an opened position for a fuel atomization state.
Figure 10:
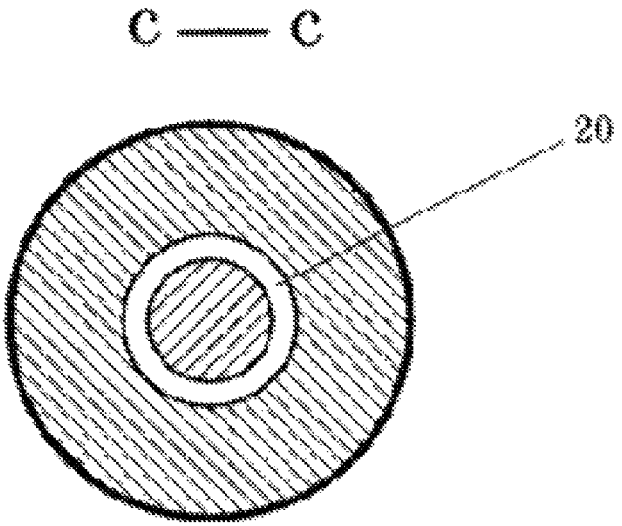
FIG. 10 is a sectional drawing of FIG. 9 along C-C. An annular section (20) in the gap of a spray hole (11) between a transitional cambered surface (19) of a lining (4) at a spray hole (11) and a transitional cambered surface (18) of a throttling guidance cone (13) at a spray hole (11) is shown; in the drawing, the needle valve (5) is at an opened position for a fuel atomization state.

When the oil pump stops supplying the fuel, the needle valve (5) is pressed by a pressure spring of a fuel injector, as shown in FIG. 7. The fuel injector and the nozzle are referred to as a fuel injector assembly. The body of the fuel injector is internally provided with a fuel inlet, a filter element, the pressure spring, a pressure adjusting shim, oil feed passages and an oil return connector, etc. These components are not part of the nozzle and thus not shown in the figures. A seat surface (16) at the head mates a seat surface (17) of the spin chamber (10) to close the spray hole (11).

It is to be noted that:

1. The lining (4) and the needle valve body (1) may exhibit different expansion factors, and thus should constitute an easy interference fit therebetween, this is to prevent them from being loosened under high temperature and high pressure, which may cause leakage. The structural size and the machining quality of the nozzle are to be taken seriously as they can greatly influence atomization quality. Any place where the fuel flows, such as the tangential holes (9), the spin chamber (10) and the spray hole (11), should have a rather high degree of finish. The spin chamber (10) and the spray hole (11) should be concentric, and the tangential holes (9) should be tangential to the spin chamber (10). Any main dimension should not exceed a respective tolerance range as specified.

2. The total number of tangential holes (9) should be more than 2, and they should be distributed uniformly. The sum of the cross areas of the uniformly distributed tangential holes (9) should not exceed the sum of the cross areas of the oil feed passages (3, 6). It is proper to have more tangential holes (9) in number such that fuel can be distributed uniformly along the spin chamber (10) to realize better atomization quality. However, if the tangential holes (9) are too many, machining will be more difficult; besides, when an excessive number of tangential holes (9) are provided, the cross area of each hole will be relatively small and thus easily blocked during operation, and atomization quality cannot be improved well. Typically, 3 to 6 tangential holes are appropriate. The length of the tangential holes (9) should not be too short, otherwise fuel may enter the spray hole (11) directly and eddy flow cannot be formed. Factors, such as the number, length, diameter, flow, flow rate and tangential injection angle of the tangential holes (9), the diameter of the spin chamber (10), the diameter of the spray hole (11) and a needle valve lift (14), jointly make up the flow characteristics and also participate in the adjustment and control of eddy flow intensity. These factors can be matched in accordance with the cyclical fuel injection quantity of engine power, the structure of the combustion chamber and the mixing method.

3. The injection tangential angle and levelness of the tangential holes (9), the taper of the seat surface (16) of the spin chamber (10), the geometrical shape and flow cross area of the spray hole (11), the needle valve lift (14) and an injection guidance angle (21) of the spray hole (12) are interacted with each other and jointly make up different spray cone angles (22).

4. The tangential holes (9) can be round, square or elliptical according to the machining method and requirements. The tangential injection angle and the spinning direction of the tangential holes (9) being either clockwise or anticlockwise should be adjusted according to the mixing method. The injection level angle of the tangential holes (9) should be close to the angle of the seat surface (16) of the needle valve (5), so as to reduce front impact between partial fuel injected through the tangential holes (9) and the seat surface (16) of the needle valve (5).

5. The taper of the seat surface (16) of the needle valve (5) should be equal to that of the seat surface (17) of the spin chamber (10), thereby ensuring a sealing precision for the mated seat surface (16) of the needle valve (5) and seat surface (17) of the spin chamber (10), so as to possibly reduce the space of remaining fuel.

6. Fuel splitting is started in the spin chamber (10), and an extremely small proportion of air is mixed. As fuel is spun through the tangential holes (9) and the spin chamber (10), the injection timing should be advanced a little bit in time.

7. According to HCCI characteristics and the atomization method of the nozzle, the nozzle should be arranged as close to a central top location of the combustion chamber as possible so as to guide the umbrella-like fuel film spray that spins at a high speed, thereby preventing "wetted wall". the penetration rate should not be smaller than 1, thus preventing flames from being "locked" in the central area and causing insufficient combustion.

8. A transitional cambered surface (18) of the throttling guidance cone (13) is designed to prevent the tangential eddy flow of the tangential holes (9) from vertically impacting the cylindrical surface of the throttling guidance cone (13) and the resulted slight bounce-back. If the transition cambered surface (18) is not adopted, the length of the spray hole (11) should be shortened accordingly. However, wear of the spray hole (11) may be quickened.

9. Considering that a one-time injection strategy is more suitable for high-compression-ratio, high-speed and high-load HCCI operations, a multi-pulse injection may not be adopted. Thus, only one group of tangential holes (9) are shown in the drawing. Various internal combustion engines differ a lot in power. For small and medium-size high speed internal combustion engines that do not need pre-injection, one group of tangential holes (9) is sufficient. For high power low speed internal combustion engines that need both pre-injection and main injection, two groups of tangential holes (9) may be more appropriate. The two groups of tangential holes (9) can be overlapped from top down to respectively fulfil the requirements of pre-injection and main injection. That is, a group of low flow tangential holes (9) close to the spray hole may be designed for pre-injection, while a group of high flow tangential holes (9) located thereabove may be designed for main injection. The lift of the needle valve (5) may be increased as well, and the two groups of tangential holes (9) from top down are opened sequentially to achieve the two injections.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A centrifugal conical-spray nozzle for spraying fuel in an engine, the centrifugal conical-spray nozzle comprising:

a needle valve body;

a needle valve having a first seat surface;

a lining surrounding the needle valve and having a first transitional cambered surface;

a throttling guidance cone provided on a head portion of the needle valve, the throttling guidance cone having a second transitional cambered surface opposing the first transitional cambered surface;

a pressure chamber surrounding the needle valve;

a spin chamber surrounding the throttling guidance cone and having a second seat surface configured to mate with the first seat surface;

three or more tangential holes provided between the pressure chamber and the spin chamber and uniformly distributed around the spin chamber;

a plurality of fuel feed passages each directly connected to a respective one of the three or more tangential holes and also to the pressure chamber;

a spray hole; and a spray opening, wherein:

the lining, the needle valve, the plurality of fuel feed passages, the pressure chamber, the three or more tangential holes, the spin chamber, the spray hole and the spray opening are provided inside the needle valve body, the three or more tangential holes are disposed tangentially with respect to the spin chamber in a clockwise or anticlockwise manner configured to generate a circumferential spinning movement of the fuel inside the spin chamber before the fuel is sprayed into the engine from the spray hole through the spray opening, the first seat surface is configured to either mate with the second seat surface within a sealing precision to close the spray hole and stop the spraying of the fuel into the engine, or to separate from the second seat surface to open the spray hole and facilitate the spraying of the fuel into the engine, and when the first seat surface mates with the second seat surface within the sealing precision to close the spray hole, the needle valve seals the three or more tangential holes from the spin chamber.

2. The centrifugal conical-spray nozzle of claim 1, wherein the lining, the plurality of fuel feed passages, the pressure chamber, the three or more tangential holes, the spin chamber, the spray hole and the spray opening are integrated, and wherein the lining and the needle valve body constitute an interference fit.

3. The centrifugal conical-spray nozzle of claim 1, wherein:

the first transitional cambered surface comprises a surface of the lining facing the spray hole, the second transitional cambered surface comprises a surface of the throttling guidance cone facing the spray hole, an injection guidance angle is defined by the throttling guidance cone at the spray opening, a rotary spray cone angle is defined by the lining at the spray opening, and an annular section is formed by a gap between the first transitional cambered surface and the second transitional cambered surface, the annular section adjustable to control a cyclical fuel injection quantity.

4. The centrifugal conical-spray nozzle of claim 1, wherein a sum of cross areas of the three or more tangential holes is smaller than a sum of cross areas of the plurality of fuel feed passages.

5. The centrifugal conical-spray nozzle of claim 1, wherein each of the three or more tangential holes has a round, square or elliptical shape.

6. The centrifugal conical-spray nozzle of claim 1, wherein, when the first seat surface separates from the second seat surface to open the spray hole, the second transitional cambered surface functions to facilitate the circumferential spinning movement of the fuel inside the spin chamber.

* * * * *